US006029804A

United States Patent [19]

Flynn

[11] Patent Number: 6,029,804

[45] Date of Patent: Feb. 29, 2000

[54] DUAL-CHAMBERED INSTRUMENT CARRYING CASE

[75] Inventor: Timothy R. Flynn, Elkhorn, Wis.

[73] Assignee: Ameritage, Ltd., Elkhorn, Wis.

[21] Appl. No.: 09/103,363

[22] Filed: Jun. 23, 1998

Related U.S. Application Data

[63] Continuation-in-part of application No. 08/963,330, Nov. 3, 1997.

[51] Int. Cl.[7] ..... B65D 81/18

[52] U.S. Cl. ..... 206/14; 206/204; 206/213.1; 206/314; 220/522; 312/31.01

[58] Field of Search ..... 206/14, 314, 204, 206/213.1; 190/110, 111; 220/522; 312/31.01

[56] References Cited

U.S. PATENT DOCUMENTS

| | | | |
|---|---|---|---|
| D. 260,700 | 9/1981 | Patrick et al. | D3/74 |
| D. 269,922 | 8/1983 | Dembicks | D3/73 |
| 1,624,994 | 4/1927 | Stark | 206/14 |
| 2,156,910 | 5/1939 | Brooks | 206/14 |
| 3,596,754 | 8/1971 | Peterson, Jr. | 206/14 |
| 3,901,384 | 8/1975 | Lee et al. | 206/314 |
| 4,427,113 | 1/1984 | Wanner | 206/314 |
| 4,428,892 | 1/1984 | Berliner | 312/31.01 |
| 4,433,781 | 2/1984 | Hummel | 206/314 |
| 4,531,632 | 7/1985 | Weber | 206/14 |
| 4,846,340 | 7/1989 | Walther | 206/14 |
| 5,116,005 | 5/1992 | LaGoy | 248/168 |
| 5,441,134 | 8/1995 | Carson | 190/111 |
| 5,713,465 | 2/1998 | Choe | 206/314 |

*Primary Examiner*—Jim Foster
*Attorney, Agent, or Firm*—Brown, Pinnisi & Michaels, P.C.

[57] ABSTRACT

An improved musical instrument carrying case combines a well-placed storage space for bows and accessories with a humidity control system to completely protect and preserve the instrument. The case includes a base and an upper lid which together form the outer surface of the case. Inside the case, a lower lid divides the case into two compartments. A first compartment is formed between the lower lid and the base of the case, while a second compartment is formed between the lower lid and the upper lid. The first compartment is preferably lined with a protective padding which has a molded primary chamber for the instrument. In addition to the primary chamber, a humidity control system and an accessory chamber are preferably between the lower lid and the base of the case. Within the second compartment is a cache for a plurality of bows or other accessories. By separating the instrument and bows into two different compartments, the life of bow hairs and the wooden body of the instrument is prolonged. The addition of the humidity control system ensures the proper temperature and humidity to completely protect and preserve the instrument.

19 Claims, 2 Drawing Sheets

DUAL-CHAMBERED INSTRUMENT CARRYING CASE

REFERENCE TO RELATED APPLICATIONS

This is a continuation-in-part of copending application Ser. No.08/963,330, filed Nov. 3, 1997, pending hereby incorporated herein by reference.

FIELD OF THE INVENTION

The invention relates generally to musical instrument carrying cases, and in particular, to a dual-chambered musical instrument carrying case that optionally includes a humidity control system.

BACKGROUND OF THE INVENTION

Instrument carrying cases for musical instruments conventionally include a chamber for the instrument. This chamber is often hinged with a lid to form such a case. Commonly, interior compartments are placed within the chamber for accessories such as bows, extra reeds, tuners, and the like.

Bows are typically stored in the lid of a stringed instrument case, with no material to separate the stringed instrument from the bows. This causes significant problems. Bow hair is very fragile and can easily be destroyed by getting it caught on, for example, a fingernail or a tuning peg. After bow hairs are significantly damaged, they must be replaced in a costly process. Bow hairs have rosin on them, which is very dangerous to the wood of the instrument. The wood must be wiped clear of rosin every time the instrument is played to ensure that the rosin does not destroy the wood. While conventional cases do have a space to ensure that there is no direct contact between the bow and the instrument, the rosin is in very close proximity to the instrument, thereby potentially causing a problem.

Various solutions have been attempted to solve this problem.

U.S. Pat. No. 5,441,134 (Carson) discloses an instrument carrying case that has two chambers where the second chamber can only be accessed through means other than through the first chamber. The second chamber is meant to carry the musician's accessories. There is plenty of room for musician's accessories, but to access the second chamber, it is necessary to close the first chamber before opening the second chamber.

U.S. Pat. No. 3,901,384 (Lee et al.) discloses an instrument carrying case that has one chamber. There is a recessed cavity for the instrument as well as a cavity for the accessories. However, the cavity for the accessories is lacking in size as it only uses the largest area not occupied by the instrument or supporting elements.

U.S. Pat. No. 4,427,113 (Wanner) discloses an instrument carrying case for wind instruments having an instrument storage chamber formed therein. A disadvantage is that the instrument has to be inserted into the case by its end. This carrying case is not suitable for stringed instruments.

The environment in which the instrument is stored affects the reliability, sound, condition, and life-span of that instrument. Extreme humidity or temperature destroys the materials of an instrument. Ideal conditions of temperature and humidity are rarely met within the instrument carrying case.

When considering a carrying case for a stringed instrument, the musician must see whether the case provides for storage of equipment such as bows or if it can provide an atmosphere of ideal temperature and humidity conditions. What is needed is a case for carrying stringed musical instruments where the instrument is completely protected as well as the accessories, mainly the bows. The instrument needs to be protected in a few ways, encompassing all that is described above. There should be ample storage for the bows that should be kept away from the instrument as well as humidity control to adjust temperature and humidity.

SUMMARY OF THE INVENTION

Briefly stated, an improved musical instrument carrying case combines a well-placed storage space for bows and accessories with a humidity control system to completely protect and preserve the instrument. The case includes a base and an upper lid which together form the outer surface of the case. Inside the case, a lower lid divides the case into two compartments. A first compartment is formed between the lower lid and the base of the case, while a second compartment is formed between the lower lid and the upper lid. The first compartment is preferably lined with a protective padding which has a molded primary chamber for the instrument. In addition to the primary chamber, a humidity control system and an accessory chamber are preferably between the lower lid and the base of the case. Within the second compartment is a cache for a plurality of bows or other accessories. By separating the instrument and bows into two different compartments, the life of bow hairs and the wooden body of the instrument is prolonged. The addition of the humidity control system ensures the proper temperature and humidity to completely protect and preserve the instrument.

According to an embodiment of the invention, a musical instrument carrying case includes a base, an upper lid hingeably connected to the base, and a lower lid hingeably connected to the base, wherein the lower lid is entirely encompassed by the upper lid and the base when the upper lid is in a closed position.

According to an embodiment of the invention, a musical instrument carrying case includes a base, an upper lid, a lower lid, first means for connecting the upper lid to the base, second means for connecting the lower lid to the base, wherein the lower lid is entirely encompassed by the upper lid and the base when the upper lid is in a closed position, and first means for fastening the lower lid to the upper lid.

According to an embodiment of the present invention, a musical instrument carrying case includes a base, an upper lid hingeably connected to the base, a lower lid hingeably connected to the base, wherein the lower lid is entirely encompassed by the upper lid and the base when the upper lid is in a closed position, a compartment formed by the lower lid and the base when the lower lid is in a closed position, a humidity control system in the compartment, a primary chamber in the compartment for storing the musical instrument, and a secondary compartment formed between the lower lid and the upper lid when the lower lid is in the closed position and the upper lid is in the closed position.

DESCRIPTION OF THE PREFERRED EMBODIMENT

Figure 1:
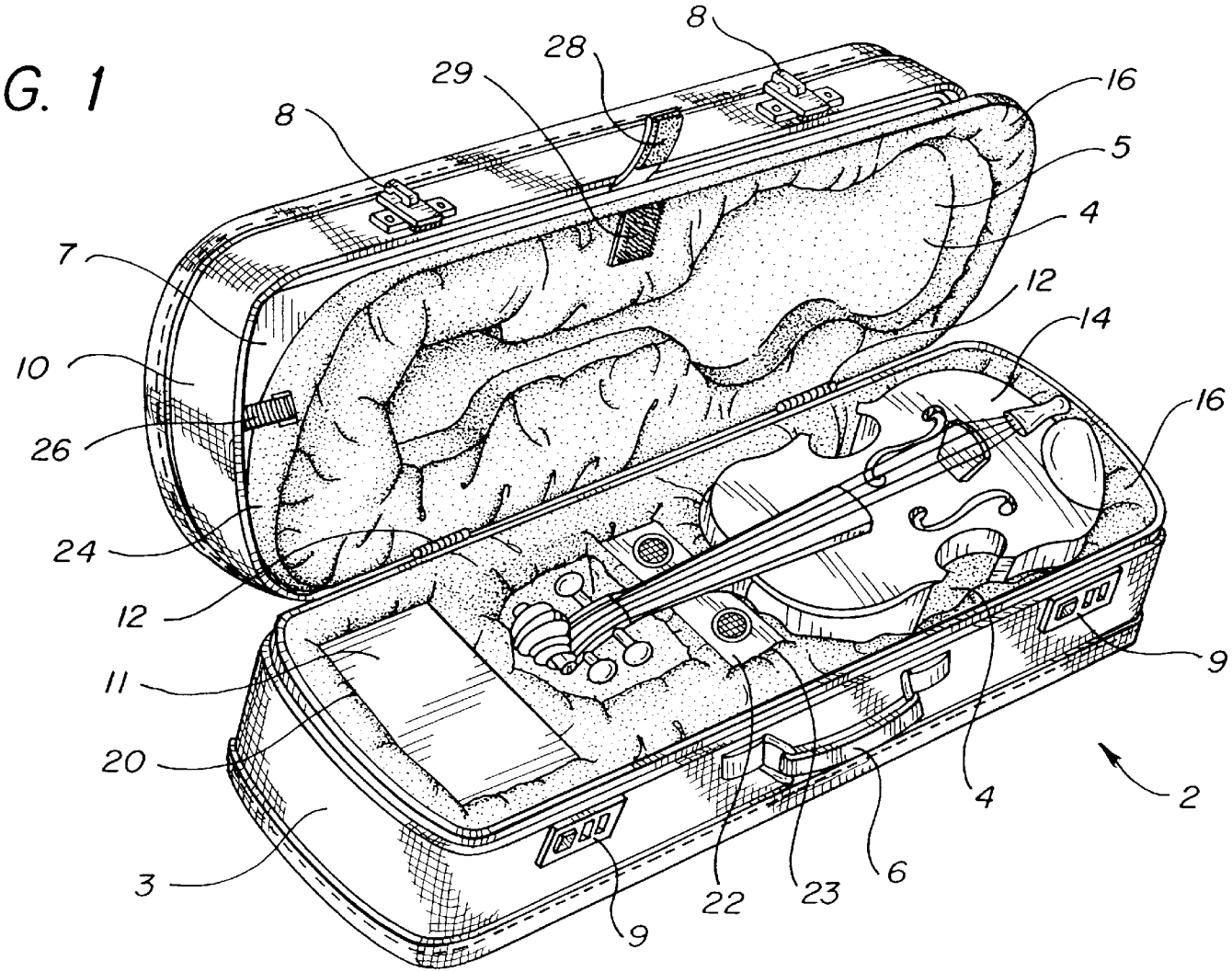
FIG. 1 shows a perspective view of a stringed musical instrument carrying case according to an embodiment of the invention with both an upper lid and a lower lid in an open position.

Referring to FIG. 1, an instrument carrying case 2 includes a first compartment 5 formed by a base 3 and a lower lid 24. A second compartment 7 is formed by lower lid 24 and an upper lid 10. Upper lid 10 and lower lid 24 are hingeably attached to base 3 by a plurality of hinges 12. Upper lid 10 and lower lid 24 optionally share the same hinges 12. For this disclosure, lower lid 24 is considered in a closed position when lower lid 24 rests on base 3. Upper lid 10 is considered in a closed position when upper lid 10 rests on base 3.

A primary chamber 4 within first compartment 5 is preferably shaped for the particular musical instrument that the case is designed to carry. An instrument 14, such as a violin, for example, fits in primary chamber 4 of FIG. 1, but primary chamber 4 can be easily adapted for other stringed instruments such as violas, cellos, and basses or an instrument with a separate component such as a slide from a trombone.

Primary chamber 4 is defined by a material 16 on both base 3 and lower lid 24 that is suitable for storing a musical instrument and a stringed instrument in particular. Material 16 is preferably generally of a rigid form retaining substance and only slightly compressible, optionally having a thin outer shell that is a plush velvet, velour, or similar velutinous material. Material 16 can be foam rubber, plastic, or the like, depending on cost considerations and individual taste. Material 16 is shaped to form primary chamber 4 that varies in shape depending on the particular instrument carried in instrument carrying case 2. Material 16 preferably completely envelops instrument 14 when instrument 14 is placed in primary chamber 4 and lower lid 24 is closed onto base 3. The shape of material 16 in primary chamber 4 preferably provides padding in all directions for instrument 14. Primary chamber 4 is shaped, in this particular case, so that the strings of instrument 14 face lower lid 24 when case 2 is closed.

A humidity control system 22 fits optionally fits into a humidity control system chamber 23. Humidity control system 22 preferably includes two separate compartments adapted to receive a humidifier (not shown) and a desiccant filled pouch (not shown). It should be noted that alternative embodiments of the invention envision the use of more than two compartments as needed by the instrument owner. The humidifier (not shown) operates to maintain the relative humidity of instrument 14 when instrument 14 is stored, transported, or moved in carrying case 2.

The stability of the environment of carrying case 2 is controlled by the owner or caretaker of the instrument carrying case as follows. When the case humidity is above 65% the owner inserts a desiccant pouch (not shown) into one compartment of humidity control system 22 and removes the humidifier (not shown) from the other compartment. Alternatively, the humidifier (not shown) is left in carrying case 2 but not recharged with water. When the humidity within case 2 is below 35%, or the atmospheric conditions are dry, the desiccant pouch (not shown) is removed from its compartment while the humidifier (not shown) is returned to its designated compartment. The most preferable humidity range to maintain within the interior of carrying case 2 is 45% to 55% humidity. When these alternative strategies are used according to locale ambient humidity conditions, a stable environment is created and maintained for musical instrument 14. In addition, the owner of case 2 retains the flexibility to select the exact desired humidity for instrument 14 by manipulating the amount of desiccant used or controlling the recharging of the humidifier.

An accessory chamber 20 is preferably adjacent primary chamber 4 in first compartment 5. Accessory chamber 20 is reserved for accessories such as rosin, tuners, music sheets, or the like. Accessory chamber 20 optionally is covered by a cover 11 to prevent accessories from dislodging when case 2 is transported.

Lower lid 24 is fastened to upper lid 10 by a fastener 28. Fastener 28 is preferably of VELCRO with one end secured to an inside of upper lid 10 while another end includes VELCRO hooks. VELCRO loops strip 29 is secured to material 16 or preferably directly to lower lid 24. When lower lid 24 is secured to upper lid 10 by fastener 28, opening case 2 by raising upper lid 10 reveals first compartment 5. Second compartment 7 is hidden and its contents remain undisturbed. Then, by unfastening fastener 28, second compartment 7 is easily accessible. At least two safety ribbons 26 connecting the inside of upper lid 10 to an outer side of lower lid 24 prevent the underside of lower lid 24 from banging down on instrument 14 when fastener 28 is unfastened. Safety ribbons 26 are optionally adjustable in length to control the distance between upper lid 10 and lower lid 24 when opening upper lid 10. When lower lid 24 is resting on instrument 14 and upper lid 10 is open, lower lid 24 can be raised by pulling on safety ribbons 26.

A plurality of latches 8 on upper lid 10 cooperate with corresponding latch parts 9 on base 3 to keep case 2 closed. Latch parts 9 are optionally lockable with a key (not shown) or combination (not shown). A handle 6 is preferably attached to case 2 for ease of handling.

Figure 2:
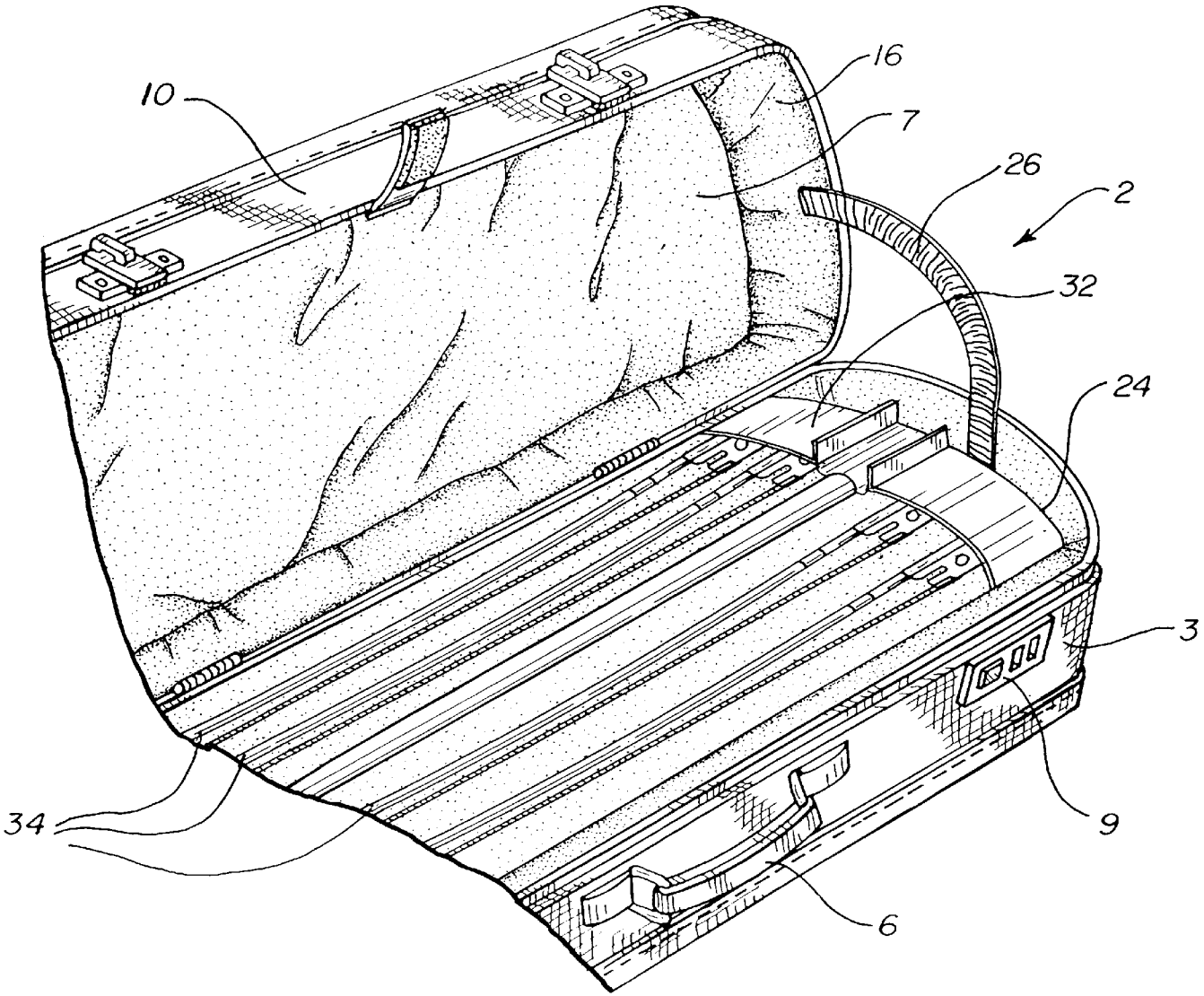
FIG. 2 shows a second compartment and housing for accessories on a lower lid of the case shown in FIG. 1 with the lower lid in a closed position.

Referring to FIG. 2, a cache 32 is installed on an upper side of lower lid 24 in second compartment 7. For a stringed instrument such as instrument 14, cache 32 is used for storing a plurality of bows 34. Bows 34 are placed in cache 32 to keep bows 34 away from instrument 14 so that bow hairs of bows 34 are in a completely separate compartment from instrument 14, thus preventing rosin from bows 34 from befouling instrument 14. Material 16 preferably lines upper lid 10 to protect bows 34 from damage.

For instruments other than stringed instruments, second compartment 7 provides additional storage for accessories such as sheet music, a small music stand, or the like. For an instrument such as the trombone, second compartment 7 is optionally used to store the slide.

Accordingly, it is to be understood that the embodiments of the invention herein described are merely illustrative of the application of the principles of the invention. Reference herein to details of the illustrated embodiments are not intended to limit the scope of the claims, which themselves recite those features regarded as essential to the invention.

What is claimed is:

1. A musical instrument carrying case, comprising:

a base;

an upper lid hingeably connected to said base;

a lower lid hingeably connected to said base wherein said lower lid is entirely encompassed by said upper lid and said base when said upper lid is in a closed position and wherein said form retaining lower lid retains a molded curvilinear form of said musical instrument; and a humidity control system connected to said base.

2. A musical instrument carrying case, comprising:

a base;

an upper lid hingeably connected to said base;

a lower lid hingeably connected to said base, wherein said lower lid is entirely encompassed by said upper lid and said base when said upper lid is in a closed position and wherein said form retaining lower lid retains a molded curvilinear form of said musical instrument;

wherein a primary chamber is formed by a first material attached to an underside of said lower lid and a second material attached to said base and said primary chamber is shaped according to a particular musical instrument carried in said case;

an accessory chamber connected to said base;

a secondary compartment formed between said lower lid and said upper lid when said lower lid is in a closed position and said upper lid is in said closed position; and a cache for storing at least one bow in said secondary compartment.

3. A musical instrument carrying case according to claim 2, wherein a protective material is attached to an underside of said upper lid.

4. A musical instrument carrying case according to claim 3, further comprising at least one safety ribbon attached to said lower lid.

5. A musical instrument carrying case according to claim 4, further comprising means for fastening said upper lid to said lower lid.

6. A musical instrument carrying case according to claim 5, further comprising a humidity control system attached to said base.

7. A musical instrument carrying case, comprising:

a base;

an upper lid;

a lower lid;

first means for connecting said upper lid to said base;

second means for connecting said lower lid to said base, wherein said lower lid is entirely encompassed by said upper lid and said base when said upper lid is in a closed position; and first means for fastening said lower lid to said upper lid.

8. A musical instrument carrying case according to claim 7, further comprising second means for fastening said upper lid to said base.

9. A musical instrument carrying case according to claim 7, further comprising means for forming a first protective chamber for said musical instrument between said base and said lower lid.

10. A musical instrument carrying case according to claim 7, further comprising means for forming a second protective chamber between said upper lid and said lower lid.

11. A musical instrument carrying case according to claim 10, further comprising means for storing at least one bow in said second protective chamber.

12. A musical instrument carrying case according to claim 7, further comprising means for controlling humidity within said first protective chamber.

13. A musical instrument carrying case, comprising:

a base;

an upper lid hingeably connected to said base;

a rigid form retaining lower lid hingeably connected to said base, wherein said lower lid is entirely encompassed by said upper lid and said base when said upper lid is in a closed position;

a compartment formed by said lower lid and said base when said lower lid is in a closed position;

a humidity control system in said compartment;

a primary chamber in said compartment for storing said musical instrument; and a secondary compartment formed between said lower lid and said upper lid when said lower lid is in said closed position and said upper lid is in said closed position.

14. A musical instrument carrying case according to claim 13, wherein said primary chamber is formed by a protective padding material on said base and an underside of said lower lid.

15. A musical instrument carrying case according to claim 14, wherein said primary chamber is shaped corresponding to said musical instrument carried in said case.

16. A musical instrument carrying case according to claim 13, further comprising an accessory chamber in said compartment.

17. A musical instrument carrying case according to claim 13, further comprising a cache on a topside of said lower lid.

18. A musical instrument carrying case according to claim 17, wherein said cache is effective for securing at least one bow.

19. A musical instrument carrying case according to claim 13, further comprising means for fastening said upper lid to said lower lid whereby, when said upper lid is fastened to said lower lid, opening said case by lifting said upper lid also lifts said lower lid to expose said primary chamber.

* * * * *

UNITED STATES PATENT AND TRADEMARK OFFICE

CERTIFICATE OF CORRECTION

PATENT NO. : 6,029,804
DATED : February 29, 2000
INVENTOR(S) : Timothy R. Flynn

It is certified that error appears in the above-identified patent and that said Letters Patent is hereby corrected as shown below:

Title page,
Item [73], should read as follows:
-- [73] Assignee: GWW, Inc. Elkhorn, Wis. --

Signed and Sealed this

Fifth Day of August, 2003

JAMES E. ROGAN
*Director of the United States Patent and Trademark Office*